United States Patent [19]

Zarogatsky et al.

[11] Patent Number: 4,655,405

[45] Date of Patent: Apr. 7, 1987

[54] INERTIA CONE CRUSHER

[75] Inventors: Leonid P. Zarogatsky; Nikolai A. Ivanov; Mikhail F. Korolkov; Villi R. Laubgan; Andrei N. Safronov, all of Leningrad, U.S.S.R.

[73] Assignee: Vsesojuzny Nauchno-Issledovatelsky I Proektny Institut Mekhanicheskoi Obrabotki Poleznykh Iskopaemykh, Leningrad, U.S.S.R.

[21] Appl. No.: 736,698

[22] Filed: May 22, 1985

[51] Int. Cl.[4] ..... B02C 2/04

[52] U.S. Cl. ..... 241/215

[58] Field of Search ..... 241/207-216

[56] References Cited

U.S. PATENT DOCUMENTS 4,452,401 6/1984 Zarogatsky et al. ..... 241/210 X
4,566,638 1/1986 Lundin et al. ..... 241/210 X

FOREIGN PATENT DOCUMENTS 481305 8/1975 U.S.S.R. .
632388 11/1978 U.S.S.R. .
897279 1/1982 U.S.S.R. ..... 241/210

*Primary Examiner*—Mark Rosenbaum
*Attorney, Agent, or Firm*—Fleit, Jacobson, Cohn & Price

[57] ABSTRACT

An inertia cone crusher includes a housing with an outer cone secured therein and an inner cone mounted concentrically with the outer cone on a spherical support. A bearing bush carrying an unbalanced mass member is installed on the inner cone shaft to engage with its spherical end thrust bearing a spherical support of the drive shaft of a power motor. A crank supporting a carrier member for engaging the unbalanced mass member is also secured to the drive shaft. The carrier member includes a weight unbalanced with respect to the axis of rotation of the unbalanced mass member, the weight having such mass and position that its static moment is about equal in value, and opposite to the static moment of the unbalanced mass member.

4 Claims, 4 Drawing Figures

INERTIA CONE CRUSHER

FIELD OF THE ART

The invention relates to apparatus for crushing and comminuting materials, and more particularly, it deals with inertia cone crushers and may be widely used at ore preparation departments of ore concentration plants in the non-ferrous and ferrous metallurgy.

BACKGROUND OF THE INVENTION

The main assembly of inertia cone crushers making their construction and operation rather complicated is the assembly of an unbalanced mass drive of the inner cone. In this light, simplifying the above-mentioned assembly is the main trend in the improvement of inertia crushers.

Known in the art is an inertia cone crusher comprising a housing having an outer cone, an inner cone mounted concentrically with the outer cone, a spherical support of the inner cone, a shaft of the inner cone carrying a bearing bush of an unbalanced mass member connected to a drive pulley by means of a spherical support spindle, an intermediate shaft journalled in bearings of the housing, and a plate clutch (cf. USSR Inventor's Certificate No. 632388, publ. 1978). Owing to the provision of the bearing and drive spindle, the crusher requires a large space in height and much metal for its manufacture and is complicated in structure so that its industrial application is rather limited. In addition, the elastic support of the housing on the foundation lowers efficiency of crushing (output and crushing fineness).

Also known in the art is an inertia cone crusher comprising a housing, an outer cone secured in the housing, an inner cone mounted concentrically with the outer cone on a spherical support for rotation about its axis and gyratory motion about the axis of the outer cone, a shaft of the inner cone, a cylindrical bearing bush carrying an unbalanced mass member, installed on the shaft of the inner cone and having a spherical end thrust bearing, a spherical support of the bush cooperating with the end thrust bearing and rigidly connected to a drive shaft of a power motor having a carrier member cooperating with the unbalanced mass member (cf. USSR Inventor's Certificate No. 481305, publ. 1975).

In this prior art inertia cone crusher, the drive member for the unbalanced mass member is the carrier member which comprises a crank guide mounted for rotation on the crank and received in a radial groove of the unbalanced mass member.

The prior art crusher features a complicated structure of the unbalanced mass member drive and its lower reliability because of a rapid wear of the friction pair carrier member—unbalanced mass member groove. With such a construction, heavy problems arise in assembling the unbalanced mass system because it is necessary to bring in registry the unbalanced mass member groove and the carrier member without any access for inspection of mating of these members during the assembly. In addition, the prior art crusher is dynamically unbalanced and requires its elastic isolation from the foundation to avoid vibratory loading of the foundation. At the same time, the yielding system involving elastic shock-absorbers lowers the crushing force, hence production parameters of the crusher.

SUMMARY OF THE INVENTION

One object of the invention is to simplify the construction of an inertia cone crusher.

Another object of the invention is to improve reliability.

A third object of the invention is to ensure dynamic balancing of the crusher structure.

A fourth object of the invention is to improve production performance of an inertia cone crusher.

This is accomplished by that in an inertia cone crusher comprising a housing, an outer cone secured in the housing, an inner cone mounted concentrically with the outer cone on a spherical support for rotation about its axis and for gyratory motion about the axis of the outer cone, a shaft of the inner cone, a cylindrical bearing bush carrying an unbalanced mass member installed on the shaft of the inner cone and having a spherical end thrust bearing, a spherical support of the bush cooperating with the end thrust bearing and rigidly connected to a drive shaft of a power motor, a crank on the drive shaft of the power motor having a carrier member cooperating with the unbalanced mass member, according to the invention, the carrier member comprises a weight secured to the crank and unbalanced with respect to the axis of the drive shaft, the weight having such mass and position that its static moment is about equal in value, and opposite in direction to the static moment of the unbalanced mass member.

The surfaces of the carrier member engaging the unbalanced mass member are preferably provided with shock-absorbers.

The carrier member is preferably provided with an abutment ring mounted concentrically with the axis of rotation of the unbalanced mass member, the ring surrounding the unbalanced mass member with a space defined with respect to the outer surface thereof.

An adjustment means may be installed on the abutment ring for changing the amount of space.

The inertia cone crusher according to the invention features a simplified structure and high production performance. The latter is obtained by dynamically balancing the system housing—inner cone by making the carrier member in the form of a counterweight of the unbalanced mass member. The shock-absorbing system of the crusher housing is made much simpler owing to an almost complete elimination of housing vibrations. Reliability of the crusher according to the invention is improved owing to the elimination of the abovementioned friction pair and owing to the employment of shock-absorbers on the surface of interengaging drive members. The manufacture and assembly of the crusher are simplified as well.

BRIEF DESCRIPTION OF THE DRAWINGS

The invention will now be described with reference to specific embodiments thereof illustrated in the accompanying drawings, in which.

DETAILED DESCRIPTION OF THE INVENTION

Figure 1:
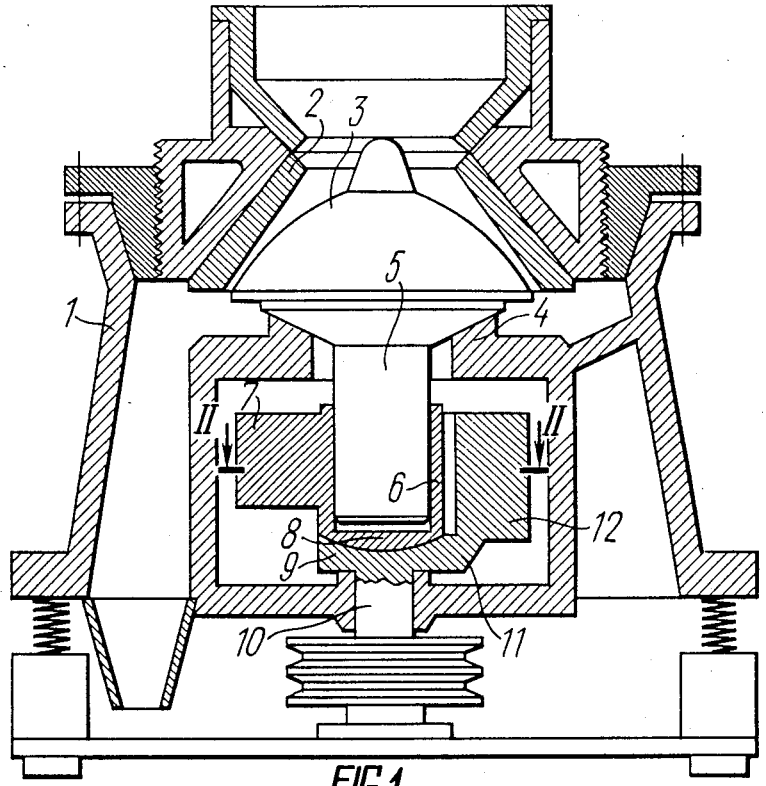
FIG. 1 shows a sectional view of an inertia cone crusher according to the invention.

An inertia cone crusher shown in FIG. 1 comprises a housing 1, an outer cone 2 secured in the housing 1 by means of a threaded joint, an inner cone 3 mounted concentrically with the outer cone on a spherical support 4 in the housing 1. The inner cone 3 is mounted for rotation about its axis of symmetry and gyratory motion about the axis of symmetry of the outer cone 2. The cone 3 has a shaft 5 in which is installed a cylindrical bearing bush 6 carrying an unbalanced mass member 7. The bush 6 has a spherical and thrust bearing 8 cooperating with a spherical support 9 which is rigidly connected to a drive shaft 10 of a power motor (not shown in the drawings). In addition, the drive shaft 10 has a crank 11 to which is rigidly connected a carrier member 12 comprising a weight unbalanced with respect to the axis of the drive shaft 10, the carrier member engaging the unbalanced mass member 7 with the end faces thereof upon rotations of the drive shaft 10. The mass of the carrier member 12 and its position (the unbalance with respect to the axis of the shaft 10) are chosen in such a manner that the values of the static moments of the carrier member 12 and unbalanced mass member 7 should be about equal to each other. In this embodiment of the crusher, the unbalanced mass member 7 and the carrier member 12 are made in the form of 175°-sectors so that there is a space defined between their vertical end faces to ensure freedom of radial and angular movement thereof relative to each other. The carrier member 12 is the drive member for the unbalanced mass member 7. Shockabsorbers 13 are provided (FIG. 2) on the vertical end faces of the carrier member 12 engaging the unbalanced mass member 7, the shock-absorbers being made of an elastic material such as rubber and extending vertically over a part of the end faces of the carrier member 12.

Figure 2:
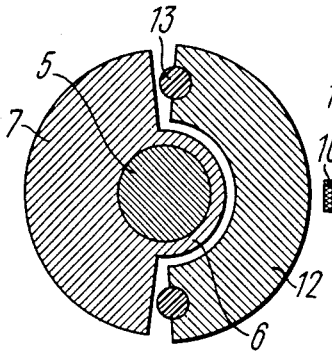
FIG. 2 is a sectional view along line II—II in FIG. 1 showing an inner cone shaft, bearing bush carrying an unbalanced mass member and a carrier member.
Figure 4:
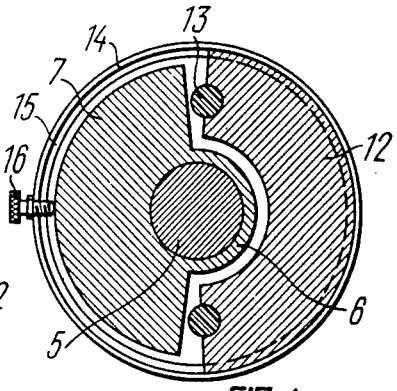
FIG. 4 is a sectional view taken along line IV—IV in FIG. 3 showing the inner cone shaft, bearing bush carrying an unbalanced mass member and a carrier member.
Figure 3:
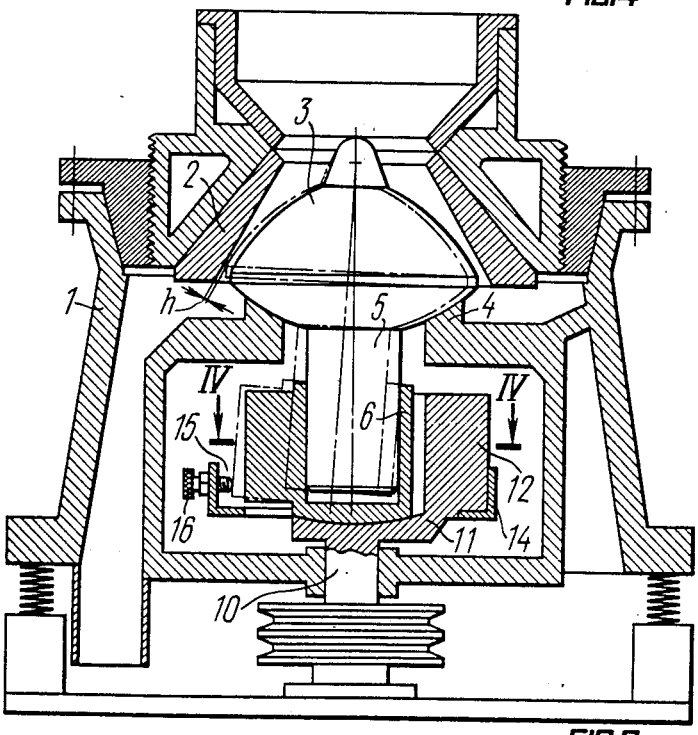
FIG. 3 is ditto of FIG. 1, with an abutment ring and space adjustment means.

In the embodiment of the inertia cone crusher shown in FIGS. 3, 4, the difference from the crusher shown in FIGS. 1, 2 resides in that the carrier member 12 is provided with an abutment ring 14 mounted concentrically with the axis of rotation of the unbalanced mass member 7 and surrounding the unbalanced mass member 7 with a space 15 defined with respect to the outer surface of the unbalanced mass member 7. The ring 14 is provided with a screw adjustment means 16 for changing the amount of this space 15.

The inertia cone crusher functions in the following manner.

During rotation of the drive shaft 10 the carrier member 12 pushes the unbalanced mass member 7 and, at the same time, generates a centrifugal force applied to the housing 1. The unbalanced mass member 7 rotating together with the drive shaft 10 also generates a centrifugal force equal to that generated by the carrier member 12 and directed oppositely, applied to the inner cone 3 which is thus caused to perform gyratory motion on its spherical support 4. As the decrease in the clearance between the cones 2 and 3 is running along a circle, the material being treated in the space therebetween is crushed. The unbalanced mass member 7 is radially and circumferentially movable on the spherical support 9 relative to the drive shaft 10 and carrier member 12.

Deviation of the axis of the inner cone 3 from the axis of the housing 1 (as shown with dotted lines in FIG. 3) is accompanied by the deviation of the end walls of the unbalanced mass member 7 from the vertical in the zone of engagement with the mating surfaces of the carrier member 12. This results in the development of an additional tripping moment acting on the carrier member 12 and crank 11 with the shaft 10, which may bring about lowering of reliability of the assembly.

The resistance to rolling of the inner cone 3 over the outer cone during crushing fluctuates with time so that the center of gravity of the unbalanced mass member 7 may anticipate, or lag from, the vertical plane of contact between the cones 2 and 3. The provision of the space between the working end faces of the unbalanced mass member 7 and carrier member 12 enables to a large extent the harmful effect of said moment to be compensated for. At the same time, the provision of the shock-absorbers 13 on the end faces of the carrier member 12 provides for the absorption of peak forces during fluctuations of position of the interengaging members and compensation for deviations of their surfaces from the vertical. For that purpose, the length of the shock-absorbers 13 is chosen to be only a part of the height of the end faces of the carrier member 12 so as to make them function as pivot joints thus substantially lowering the value of tripping moment.

The values of the static moments of the unbalanced mass member 7 and carrier member 12 are about equal to each other.

This is explained by the fact that it is not possible to balance the crusher completely as the value of the amplitude of oscillations of the inner cone 3 is not constant so that the centrifugal force in the system inner cone 3—unbalanced mass member 7 cannot be constant. For a more complete balance of the crusher, parameters of the carrier member 12 (its mass and position) might have been chosen in such a manner that its static moment would be slightly greater than the static moment of the unbalanced mass member 7, taking into account the average centrifugal force of the inner cone 3. However, this would bring about an increase in the tripping moment acting upon the crusher housing 1. Therefore, the approximate equality of the static moments of the carrier member 12 and unbalanced mass member 7 appears to be the most expedient solution.

The abutment ring 14, which is concentrically mounted on the carrier member 12, makes it possible to limit the amplitude of deviations of the inner cone 3 from the vertical. The unbalanced mass member 7 will bear against the ring 14 with its outer periphery so that any further radial deviation of the inner cone 3 is prevented. This facility makes it possible to avoid the contact rolling of the inner cone 3 over the outer cone. The ring 14 eliminates the possibility of emergency failure since in case of uncontrollable wear of the lining and absence of the ring 14, the inner cone 3 could have inflicted damage to the spherical support 4 or housing 1 with its shaft 5 or unbalanced mass member 7.

The abutment ring 14 also makes it possible to adjust the crusher for a desired fineness of product and output. The use of means 16 for adjusting the space 15 between the unbalanced mass member 7 and ring 14 substantially enlarges the production capabilities of the crusher as it can be adjusted for crushing materials with various physico-mechanical properties to a fineness desired for the production process. The adjustment of the amount of space 15 enables the size of a discharge aperture "h" between the cones 2 and 3 to be varied respectively.

What is claimed is:

1. An inertia cone crusher comprising:

a housing;

an outer cone secured in said housing;

an inner cone rotatably mounted in said housing concentrically with respect to said outer cone;

a shaft of said inner cone extending along an axis of symmetry of said inner cone;

a cylindrical bearing bush mounted on said shaft of said inner cone;

an unbalanced mass member formed with said cylindrical bearing bush;

a spherical end thrust bearing defined by said cylindrical bearing bush;

a drive shaft adapted to be driven by a power motor;

a crank formed with said drive shaft;

a spherical support defined by said crank, said spherical support supporting said cylindrical bearing bush by said spherical end thrust bearing;

a carrier member formed with said crank;

said unbalanced mass member being radially and circumferentially movable, on said spherical support through said spherical end thrust bearing, relative to said drive shaft and relative to said carrier member;

said carrier member having vertical end faces for engaging said unbalanced mass member so that during rotation of said drive shaft, said carrier member pushes said unbalanced mass member and said carrier member, at the same time, generates a centrifugal force applied to said housing, and said unbalanced mass member rotating together with said drive shaft also generates a centrifugal force applied to said inner cone, directed opposite to and equal to said centrifugal force generated by said carrier member, to thus cause said inner cone to perform gyratory motion on said spherical support;

said carrier member comprising a weight unbalanced with respect to the axis of said drive shaft, said weight having a mass and position such that the static moment of said weight is about equal and opposite to the static moment of said unbalanced mass member.

2. An inertia cone crusher according to claim 1, comprising:

shock-absorbers provided in said surfaces of the carrier member engaging said unbalanced mass member.

3. An inertia cone crusher according to claim 1, comprising:

an abutment ring secured to said carrier member concentrically with the axis of rotation of said unbalanced mass member, the abutment ring surrounding said unbalanced mass member;

a space between the inner periphery of said abutment ring and the outer periphery of said unbalanced mass member facing said abutment ring.

4. An inertia cone crusher according to claim 3, comprising:

an adjustment means on said abutment ring for adjusting the amount of said space to limit the amplitude of the inner cone.

* * * * *